US006587029B2

(12) United States Patent
Miyamoto

(10) Patent No.: US 6,587,029 B2
(45) Date of Patent: Jul. 1, 2003

(54) HIGH-VOLTAGE VARIABLE RESISTOR

(75) Inventor: Toshiyuki Miyamoto, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/866,349

(22) Filed: May 25, 2001

(65) Prior Publication Data

US 2002/0014947 A1 Feb. 7, 2002

(30) Foreign Application Priority Data

Jun. 2, 2000 (JP) ..... 2000-165346

(51) Int. Cl.[7] ..... H01C 1/02

(52) U.S. Cl. ..... 338/273; 338/276; 338/160; 338/118; 338/220; 338/199

(58) Field of Search ..... 338/273, 276, 338/162, 118, 199, 220, 160

(56) References Cited

U.S. PATENT DOCUMENTS 5,508,678 A * 4/1996 Tsunezawa et al. ..... 338/160
5,517,171 A * 5/1996 Kotani et al. ..... 338/118
5,532,669 A * 7/1996 Tsunezawa et al. ..... 338/184
5,726,625 A * 3/1998 Hasebe et al. ..... 338/162
5,877,673 A * 3/1999 Kotani et al. ..... 338/162
5,912,613 A * 6/1999 Kotani et al. ..... 338/160
5,920,252 A * 7/1999 Nakagawa ..... 338/160
5,986,537 A * 11/1999 Kato ..... 338/68
6,200,156 B1 * 3/2001 Hiraki et al. ..... 439/395

FOREIGN PATENT DOCUMENTS

JP 7-235402 9/1995

* cited by examiner

*Primary Examiner*—Karl D. Easthom
(74) *Attorney, Agent, or Firm*—Keating & Bennett, LLP

(57) ABSTRACT

A high-voltage variable resistor includes a circuit section contained in an insulating casing, a snap-in terminal inserted in a terminal base portion of the casing and connected to an output portion of the circuit section, and an output connecting electrode inserted in the terminal base portion from a direction orthogonal to the snap-in terminal and press-fitted in and connected to the snap-in terminal. The terminal base portion of the casing has an insertion groove for guiding and inserting the snap-in terminal, an insertion hole for guiding and inserting the output connecting electrode, and a relief groove formed on a side face of the insertion groove intersecting the insertion hole. The insertion groove, the insertion hole, and the relief groove are simultaneously formed by a metal mold of the structure to be pierced.

12 Claims, 5 Drawing Sheets

HIGH-VOLTAGE VARIABLE RESISTOR

BACKGROUND OF THE INVENTION

1. Field of the Invention

The present invention relates to a high-voltage variable resistor for use, for example, in adjusting the focus voltage and the screen voltage of a television receiver or other such apparatus.

2. Description of the Related Art

Conventionally, high-voltage variable resistors called "focuspacks" are used to adjust the focus and brightness of color televisions, display monitors, and other such apparatuses. Japanese Unexamined Patent Application Publication No. 7-235402 discloses this type of high-voltage variable resistor in which a snap-in terminal having a spring portion to be contacted with a connecting electrode of a circuit board is placed in a terminal base portion of an insulating casing, and an output lead wire is press-fitted in the snap-in terminal in a perpendicular arrangement, thereby establishing a connection to the outside. This high-voltage variable resistor can be produced for low cost because the inner circuit board and the output lead wire can be electrically connected without using a conductive rubber or solder.

In the above-described high-voltage variable resistor, since the snap-in terminal is held in the terminal base portion of the casing, the terminal base portion has an insertion groove for holding both sides of the snap-in terminal, and also has an insertion hole extending perpendicular to the insertion groove so as to insert the output lead wire therein.

In order to precisely press-fit the output lead wire into a hole of the snap-in terminal, the insertion hole must be formed in precise alignment with the insertion groove.

Referring to FIG. 1, an insertion groove 2 and an insertion hole 3 that is perpendicular thereto can be simultaneously formed in a terminal base portion 1 by a metal mold 4 of the structure to be pressed shown in FIGS. 2A and 2B or by a metal mold 5 of the structure to be pierced shown in FIG. 3.

In the metal mold 4 of the structure to be pierced, a first mold 4*a* for forming the insertion groove 2 and a second mold 4*b* for forming the insertion hole 3 are simply contacted with each other. Therefore, the center axis of the second mold 4*b* does not always coincide with a required center line X, as shown in FIG. 2A, and the second mold 4*b* becomes displaced from the center line X by an amount δ due to pressure of resin, as shown in FIG. 2B. As a result, the insertion hole 3 cannot be formed at a precise position corresponding to the required center line X.

In contrast, in the metal mold 5 of the structure to be pierced, the leading end of a second mold 5*b* for forming the insertion hole 3 is pierced in a hole 5*a*1 of a first mold 5*a* for forming the insertion groove 2. Therefore, the second mold 5*b* is held at a fixed position by the first mold 5*a* even when pressure of resin or other source acts thereon, and as a result, the insertion hole 3 can be precisely formed along the required center line X.

Such use of the metal mold of the structure to be pierced provides the advantage of precisely forming the insertion hole 3, but causes a problem. That is, since a clearance lies between the hole 5*a*1 of the first mold 5*a* and the second mold 5*b*, a burr is formed at the rim of the insertion hole 3 opening toward the insertion groove 2 due to the clearance. The burr protrudes toward the inner surface of the insertion groove 2 and interferes with the insertion of the snap-in terminal into the insertion groove 2. This makes it impossible to insert the snap-in terminal to a predetermined position, and to establish a reliable connection between the snap-in terminal and the output lead wire.

SUMMARY OF THE INVENTION

In order to overcome the problems described above, preferred embodiments of the present invention provide a high-voltage variable resistor in which an insertion hole can be formed at a precise position so as to be substantially perpendicular to an insertion groove and in which a snap-in terminal can be constantly inserted to a fixed position in the insertion groove without any burrs being formed.

According to a preferred embodiment of the present invention, a high-voltage variable resistor includes an insulating casing with a terminal base portion, a circuit section contained in the casing, a snap-in terminal inserted in the terminal base portion of the casing and connected to an output portion of the circuit section, and an output connecting electrode inserted in the terminal base portion from a direction that is substantially perpendicular to the snap-in terminal and press-fitted in and connected to the snap-in terminal, wherein the terminal base portion of the casing has an insertion groove for guiding and inserting the snap-in terminal, an insertion hole for guiding and inserting the output connecting electrode, and a relief groove provided on a side surface of the insertion groove intersecting the insertion hole, and the insertion groove, the insertion hole, and the relief groove are simultaneously formed by a metal mold of the structure to be pierced.

A mold for forming the insertion groove and the relief groove and a mold for forming the insertion hole are fitted in a pierced manner, and the terminal base portion is integrally molded in this state. When the molds are separated after molding, a molding burr is formed at the intersection of the insertion groove and the insertion hole. Since the burr is formed at the relief groove, it does not interfere with the insertion of the snap-in terminal into the insertion groove. For this reason, the snap-in terminal can be easily inserted into the fixed position, and an unreliable connection between the snap-in terminal and the output connecting electrode is reliably prevented.

Preferably, the output connecting electrode is a snap-in lead wire. That is, by using a snap-in lead wire as an output terminal of the high-voltage variable resistor and press-fitting a core wire of the lead wire into the snap-in terminal via the insertion hole, connection to an external device is reliably and easily established.

Preferably, the metal mold of the structure to be pierced includes a first mold for defining the insertion groove and a second mold pierced in a hole formed in the first mold so as to define the insertion hole, and the depth of the relief groove is preferably substantially equal to or larger than that of the hole formed in the first mold. That is, the thickness of a burr formed by metal mold of the structure to be pierced will not be larger than that of the hole to be pierced. Therefore, the burr and the snap-in terminal are reliably prevented from interfering with each other by setting the depth of the relief groove to be larger than the depth of the hole to be pierced.

Further elements, characteristics, features, and advantages of the present invention will become apparent from the following description of preferred embodiments with reference to the attached drawings.

DETAILED DESCRIPTION OF PREFERRED EMBODIMENTS

A high-voltage variable resistor according to preferred embodiment of the present invention will be described below with reference to FIGS. 4 to 8.

Figure 4:
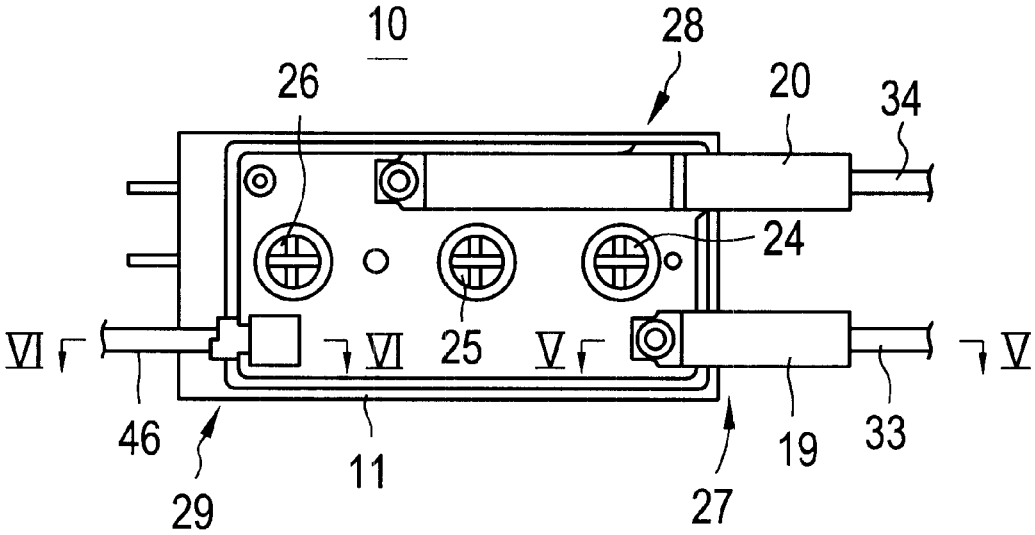
FIG. 4 is a plan view of a high-voltage variable resistor according to a preferred embodiment of the present invention.

As an example, a high-voltage variable resistor 10 of the present preferred embodiment is a snap-in type focuspack used to adjust the focus and brightness in a color television or a color display device. The high-voltage variable resistor 10 preferably includes an insulating casing 11 made of a high fire-resistant material, such as polybutylene terephthalate, polyphenylene oxide, or polycarbonate, a circuit board 23 contained in the casing 11, variable resistors 24, 25, and 26, focusing output sections 27 and 28, and a screen output section 29. Although FIG. 4 shows only control knobs of the variable resistors 24, 25, and 26, a slider attached to each of the control knobs slides on a resistor (not shown) disposed on the surface of the circuit board 23, thereby setting a desired resistance. The number of variable resistors may be one, two, or more than four. Three output sections need not always be provided, and at least one output section will do.

Figure 1:
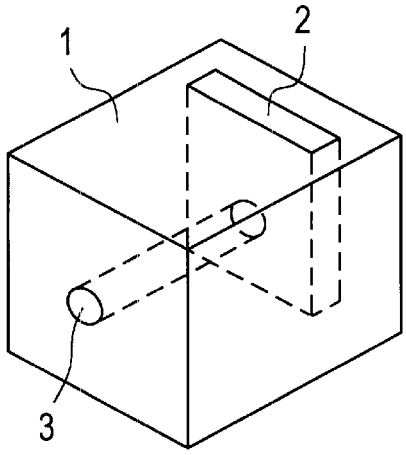
FIG. 1 is a perspective view showing the relationship between an insertion groove and an insertion hole.
Figure 2A:
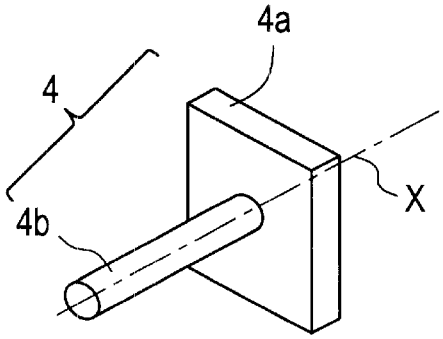
FIGS. 2A and 2B are perspective views of an example of a metal mold of the structure to be pressed.
Figure 2B:
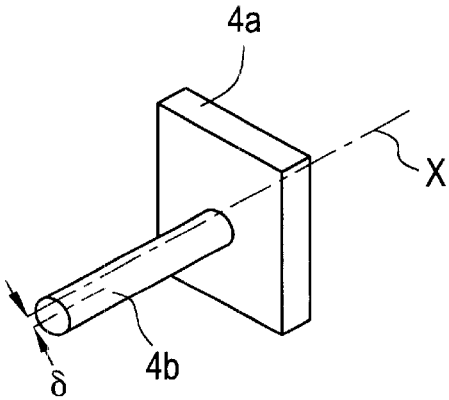
Figure 3:
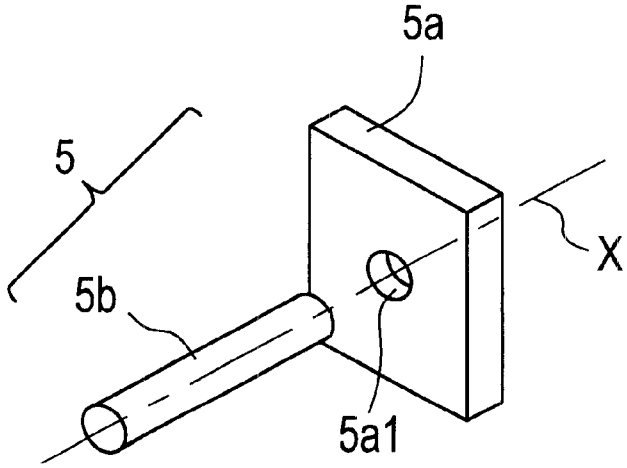
FIG. 3 is a perspective view of an example of a metal mold of the structure to be pierced.
Figure 5:
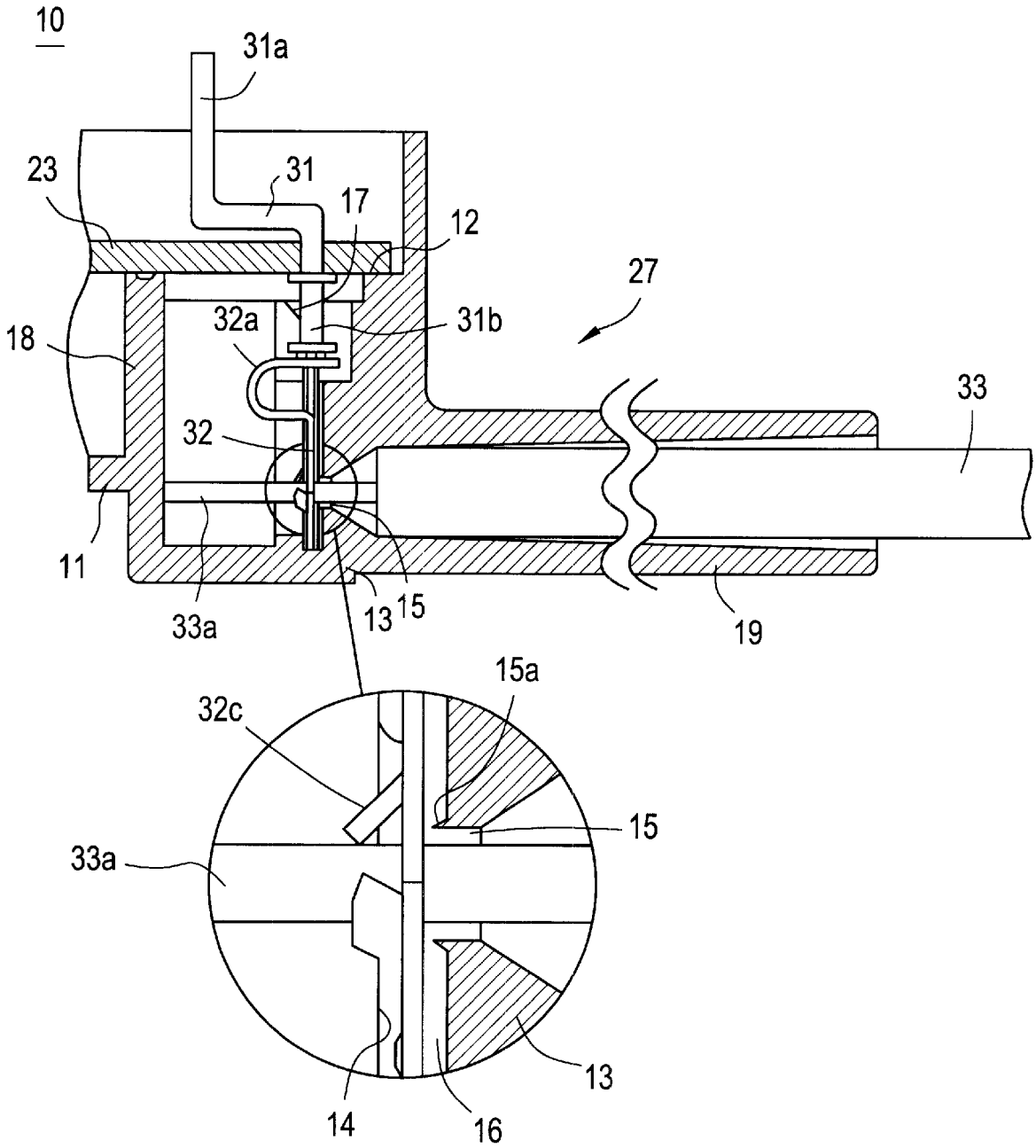
FIG. 5 is a sectional view taken along line V—V in FIG. 4.

The casing 11 is opened on one side, and has a stepped portion 12 therein, as shown in FIG. 5. The circuit board 23 is placed on the stepped portion 12, and a recess defined by the opening of the casing 11 and the circuit board 23 is filled with resin (not shown). A terminal base portion 13 is integrally molded at one end of the casing 11. The terminal base portion 13 is provided with an insertion groove 14 for guiding and inserting a snap-in terminal 32, which will be described later, and an insertion hole 15 for guiding and inserting a core wire 33*a* of an output connecting electrode 33. The insertion groove 14 and the insertion hole 15 are preferably substantially perpendicular to each other. A relief groove 16 is formed on a side surface of the insertion groove 14 at the intersection with the insertion hole 15. At an aperture of the insertion groove 14, an inclined surface 17 is provided for guiding. The insertion groove 14, the insertion hole 15, and the relief groove 16 are simultaneously formed by a metal mold of the structure to be pierced substantially similar to the mold shown in FIG. 3. The depth of the relief groove 16 is preferably larger than the depth of a hole to be pierced.

The focusing output section 27 includes a focusing output terminal 31 and a snap-in terminal 32 including a spring terminal, as shown in FIG. 5. The focusing output terminal 31 is fixed to the circuit board 23 and is electrically connected thereto. One end 31*a* of the focusing output terminal 31 protrudes toward the back of the casing 11, and the other end 31*b* thereof is in elastic contact with a spring portion 32*a* of the snap-in terminal 32 and is electrically connected thereto. In order to make the connection more reliable, the spring portion 32*a* may have an appropriate projection to be contacted with the other end 31*b* of the focusing output terminal 31.

Figure 8:
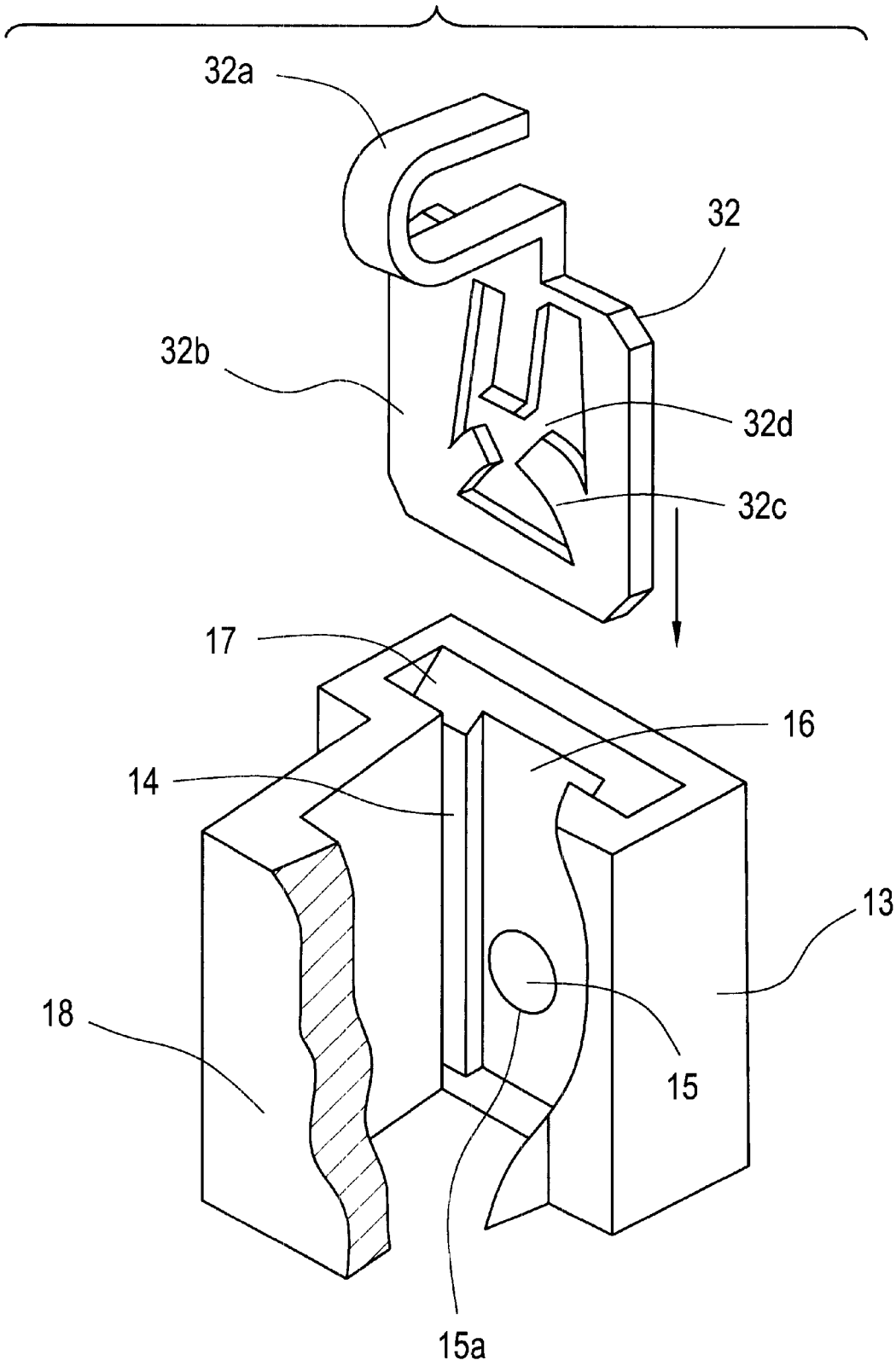
FIG. 8 is a perspective view of a terminal base portion and a snap-in terminal.

Both sides of a flat portion 32*b* of the snap-in terminal 32 are inserted in the insertion groove 14 provided in the terminal base portion 13, as shown in FIG. 8. In this case, the sides of the flat portion 32*b* are smoothly guided by the inclined surface 17 located at the aperture of the insertion groove 14. A connecting hole 32*d* having a plurality of (for example, three in FIG. 8) inwardly extending claws 32 is provided at the approximate center of the flat portion 32*b*. When the snap-in terminal 32 is inserted in the inner portion of the insertion groove 14, the connecting hole 32*d* and the insertion hole 15 are aligned with each other. Although a burr 15*a* (see FIG. 5) may be formed at the rim of the insertion hole 15 when the insertion groove 14 and the insertion hole 15 are formed simultaneously, since the relief groove 16 is formed on the side surface of the insertion groove 14 where the burr 15*a* is formed, the burr 15*a* will not protrude into the insertion groove 14 and will not interfere with the insertion of the snap-in terminal 32.

In this preferred embodiment, the focusing output connecting electrode 33 preferably includes a snap-in lead wire, and is inserted in a substantially cylindrical portion 19 protruding from the outer side of the insulating casing 11. The core wire 33*a* thereof is passed through the insertion hole 15 and is press-fitted in the connecting hole 32*d* of the snap-in terminal 32. In this case, since the connecting hole 32*d* and the insertion hole 15 are aligned, the core wire 33*a* of the output connecting electrode 33 is precisely guided into the approximate center of the connecting hole 32*d*. By press-fitting the output connecting electrode 33, the claws 32*c* of the connecting hole 32*d* are bent and put into pressed contact with the peripheral surface of the core wire 33*a* of the output connecting electrode 33, thereby preventing the core wire 33*a* from being removed or falling off. The output connecting electrode 33 and the snap-in terminal 32 are thereby electrically connected to each other. While the leading end of the core wire 33*a* of the output connecting electrode 33 contacts a side wall portion 18 located on the back side of the terminal base portion 13 in this preferred embodiment, it may not contact therewith.

The focusing output section 28 also includes a focusing output terminal (not shown) and a snap-in terminal (not shown) including a spring terminal. Since the structure of the focusing output section 28 is similar to that of the focusing output section 27, a detailed description thereof is omitted. An output connecting electrode 34 of the focusing output section 28 also preferably includes a snap-in lead wire and is inserted in a substantially cylindrical portion 20 protruding from the outer side of the insulating casing 11. A core wire thereof is passed through an insertion hole of the insulating casing 11 and is press-fitted in a connecting hole of the snap-in terminal.

Figure 6:
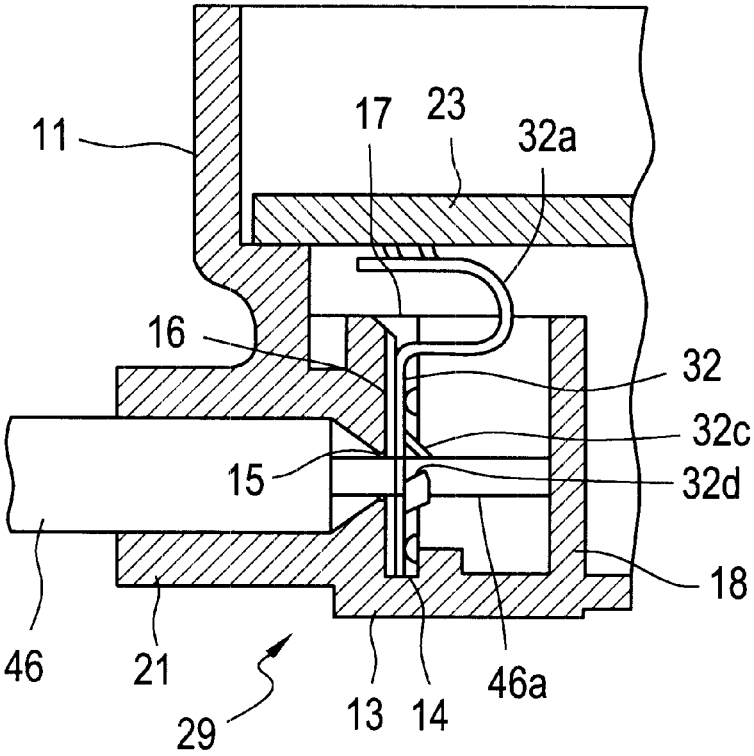
FIG. 6 is a sectional view taken along line VI—VI in FIG. 4.
Figure 7:
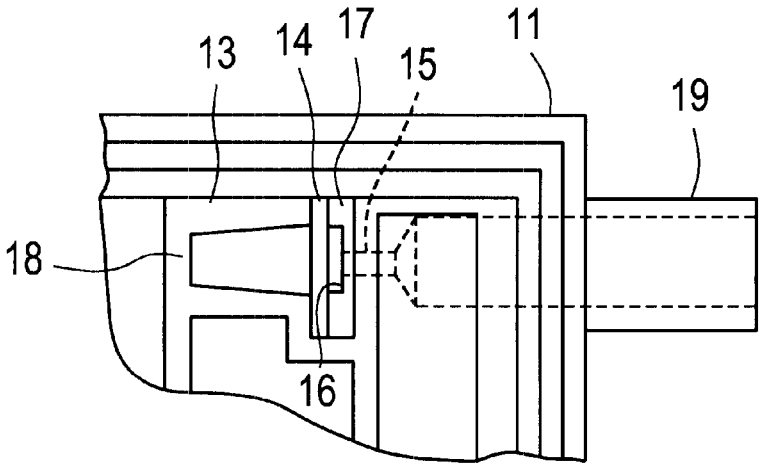
FIG. 7 is a bottom view of a portion of a casing.

The screen output section 29 has a snap-in terminal 32 including a spring terminal, as shown in FIG. 6. The structure of the screen output section 29 is substantially similar to that of the focusing output section 27 except that a spring portion 32*a* of the snap-in terminal 32 is in direct contact with a pattern electrode on the circuit board 23 and is electrically connected thereto. Therefore, components corresponding to those in FIG. 5 are denoted by the same numerals in FIG. 6, and repetitive descriptions thereof are omitted. An output connecting electrode 46 of the screen output section 29 also includes a snap-in lead wire and is inserted in a substantially cylindrical portion 21 protruding from the outer side of the insulating casing 11. A core wire 46*a* thereof is passed through an insertion hole 15 of the insulating casing 11 and is press-fitted in a connecting hole 32*d* of the snap-in terminal 32.

While the snap portion 32*a* of the snap-in terminal 32 is in electrical contact with the output terminal 31 as an example of a circuit section, or the pattern electrode on the circuit board 23 in the above-described preferred embodiments, the snap-in terminal 32 may be connected by soldering or by other means without using such a spring portion.

While output lead wires are preferably used as the output connecting electrodes 33, 34, and 46 in the above-described preferred embodiments, coupler terminals may be used instead.

As described above, according to the high-voltage variable resistor of various preferred embodiments of the present invention, since the insertion groove and the insertion hole are formed by the metal mold of the structure to be pierced, they can be molded precisely. Moreover, even when a burr is formed at the rim of the insertion hole, it does not interfere with the insertion of the snap-in terminal because of the relief groove provided on the side surface of the insertion groove. This allows the snap-in terminal to be constantly inserted to a fixed position and to be reliably connected to the output connecting electrode.

While the present invention has been described with reference to what is presently considered to be the preferred embodiment, it is to be understood that the invention is not limited to the disclosed preferred embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A high-voltage variable resistor comprising:

an insulating casing with a terminal base portion;

a circuit section contained in said insulating casing and having an output portion;

a snap-in terminal inserted in said terminal base portion of said insulating casing and connected to the output portion of said circuit section; and an output connecting electrode inserted in said terminal base portion from a direction that is substantially perpendicular to said snap-in terminal and press-fitted in and connected to said snap-in terminal; wherein said terminal base portion of said casing has an insertion groove arranged to guide and insert said snap-in terminal, an insertion hole arranged on one side of said snap-in terminal and arranged to guide and insert said output connecting electrode, and a relief groove located on the one side of said snap-in terminal and on a side surface of said insertion groove intersecting said insertion hole, and said insertion groove, said insertion hole, and said relief groove are integral and simultaneously formed from a metal mold of a structure to be pierced.

2. A high-voltage variable resistor according to claim 1, wherein said output connecting electrode is a snap-in lead wire.

3. A high-voltage variable resistor according to claim 1, wherein the high-voltage variable resistor is a snap-in type focuspack arranged to adjust the focus and brightness in one of a color television and a color display device.

4. A high-voltage variable resistor according to claim 1, wherein the insulating casing is made of one of polybutylene terephthalate, polyphenylene oxide, and polycarbonate.

5. A high-voltage variable resistor according to claim 1, wherein the circuit section includes a circuit board, a plurality of variable resistors, focusing output sections, and a screen output section.

6. A high-voltage variable resistor according to claim 5, wherein the insulating casing is opened on one side and has a stepped portion, the circuit board is provided on the stepped portion, and a recess defined by the opening of the insulating casing and the circuit board is filled with resin.

7. A high-voltage variable resistor according to claim 1, wherein the insertion groove and the insertion hole are substantially perpendicular to each other.

8. A high-voltage variable resistor according to claim 1, wherein at an aperture of the insertion groove, an inclined surface is provided.

9. A high-voltage variable resistor according to claim 1, wherein said output portion includes an output terminal including a portion extending in a direction substantially perpendicular to said circuit section, and said portion of said output terminal being electrically connected to the circuit section and in elastic contact with the snap-in terminal.

10. A high-voltage variable resistor according to claim 1, wherein said output connecting electrode is inserted into said terminal base portion.

11. A high-voltage variable resistor comprising:

an insulating casing with a terminal base portion;

a circuit section contained in said insulating casing and having an output portion;

a snap-in terminal inserted in said terminal base portion of said insulating casing and connected to the output portion of said circuit section; and an output connecting electrode inserted in said terminal base portion from a direction that is substantially perpendicular to said snap-in terminal and press-fitted in and connected to said snap-in terminal; wherein said terminal base portion of said casing has an insertion groove arranged to guide and insert said snap-in terminal, an insertion hole arranged on one side of said snap-in terminal and arranged to guide and insert said output connecting electrode, and a relief groove located on the one side of said snap-in terminal and on a side surface of said insertion groove intersecting said insertion hole, and said insertion groove, said insertion hole, and said relief groove are integral and simultaneously formed from a metal mold of a structure to be pierced; and said output portion includes an output terminal including a portion extending in a direction substantially perpendicular to said circuit section, and said portion of said output terminal being electrically connected to the circuit section and in elastic contact with the snap-in terminal.

12. A high-voltage variable resistor comprising:

an insulating casing with a terminal base portion;

a circuit section contained in said insulating casing and having an output portion;

a snap-in terminal inserted in said terminal base portion of said insulating casing and connected to the output portion of said circuit section; and an output connecting electrode inserted in said terminal base portion from a direction that is substantially perpendicular to said snap-in terminal and press-fitted in and connected to said snap-in terminal; wherein said terminal base portion of said casing has an insertion groove arranged to guide and insert said snap-in terminal, an insertion hole arranged on one side of said snap-in terminal and arranged to guide and insert said output connecting electrode, and a relief groove located on the one side of said snap-in terminal and on a side surface of said insertion groove intersecting said insertion hole, and said insertion groove, said insertion hole, and said relief groove are integral and simultaneously formed from a metal mold of a structure to be pierced; and said output connecting electrode is inserted into said terminal base portion of said insulating casing.

* * * * *